US005993703A

United States Patent [19]

Stripp et al.

[11] Patent Number: 5,993,703

[45] Date of Patent: Nov. 30, 1999

[54] PROCESS FOR PRODUCING STEEL CASTING LADLE MONOLITHIC REFRACTORY LINING

[75] Inventors: Heinz Stripp, Dinslaken; Horst Tiemann, Iserlohn; Roland Kessler, Dortmund, all of Germany

[73] Assignee: Dolomitwerke GmbH, Wülfrath, Germany

[21] Appl. No.: 08/691,978

[22] Filed: Aug. 2, 1996

Related U.S. Application Data

[63] Continuation-in-part of application No. PCT/EP95/00399, Feb. 3, 1995.

[30] Foreign Application Priority Data

Feb. 3, 1994 [DE] Germany ..... 44 03 270

[51] Int. Cl.[6] ..... F27D 1/16

[52] U.S. Cl. ..... 264/30; 264/32; 264/34; 264/315; 266/281

[58] Field of Search ..... 264/30, 32, 33, 264/34, 36, 314, 313, 315; 266/281

[56] References Cited

U.S. PATENT DOCUMENTS

| | | | |
|---|---|---|---|
| 3,716,316 | 2/1973 | Dekker et al. | 264/30 |
| 3,837,630 | 9/1974 | Kohl et al. | 264/30 |
| 3,877,673 | 4/1975 | Bisinella et al. . | |
| 3,963,815 | 6/1976 | Ezaki et al. | 264/30 |
| 4,469,309 | 9/1984 | Takashima et al. | 264/30 |
| 4,589,633 | 5/1986 | Gilson et al. | 264/30 |
| 5,279,092 | 1/1994 | Williamsen et al. | 52/514 |
| 5,505,893 | 4/1996 | Connors, Jr. | 264/30 |
| 5,511,762 | 4/1996 | Connors, Jr. et al. | 264/30 |

FOREIGN PATENT DOCUMENTS

| | | |
|---|---|---|
| 2356106 | 1/1978 | France . |
| 0373673 | 4/1923 | Germany . |
| 2143241 | 3/1973 | Germany . |
| 53-102803 | 7/1978 | Japan . |
| 57-190764 | 11/1982 | Japan . |
| 0178955 | 3/1966 | U.S.S.R. . |
| 1390895 | 4/1975 | United Kingdom . |

*Primary Examiner*—Karen Aftergut

[57] ABSTRACT

When the wall and bottom of a steel casting and handling ladle are provided at the same time with a refractory monolithic lining, the lining in the lower area of the wall is often damaged during intermediate repairs of the bottom. According to a new process, wall and bottom are lined one after the other. A hose-like inflatable sealing body is secured to the bottom part of the template 4 when beginning to introduce the casting mass in the wall area and is inflated so that it seals the template 4 up to the height that corresponds to the desired thickness of the bottom. As soon as the casting mass in the lower wall area is sufficiently set, the sealing body 2 is deflated and removed, then the refractory casting mass is introduced into the bottom area up to the desired height. This process is suitable for steel casting and handling ladles and for similar metallurgical vessels.

20 Claims, 8 Drawing Sheets

PROCESS FOR PRODUCING STEEL CASTING LADLE MONOLITHIC REFRACTORY LINING

CONTINUING APPLICATION DATA

This application is a Continuation-In-Part application of International Application No. PCT/EP 95/00399, filed on Feb. 3, 1995, which claims priority from German Patent Application No. P 44 03 270.6, filed on Feb. 3, 1994. International Application No. PCT/EP 95/00399 was pending as of the filing date of this application and the U.S. was an elected state in International Application No. PCT/EP 95/00399.

BACKGROUND OF THE INVENTION

1. Field of the Invention

This invention generally relates to a process for the manufacture of a refractory monolithic lining of the wall and bottom of a ladle for casting and treating steel or for similar metallurgical vessels, as well as a device for the performance of the process. The invention also generally relates to a process for the partial reconstruction of the refractory lining in the upper zone of the wall area of a metallurgical vessel.

2. Background Information

Similar refractory linings of the prior art for metallurgical vessels generally include a permanent lining and a working lining. Fireclays or insulating bricks are conventionally used to construct the permanent lining, and are applied on the inside of the steel shell of the vessel. The working lining is applied on top of the permanent lining, and as it subsequently comes into contact with the molten steel, it is worn away by erosion, in particular as a result of the movement of the metal bath, and by chemical attack or erosion which is caused in particular by the slags which float on top of the molten metal.

The working lining can be constructed using refractory bricks or it can be installed in the form of a castable refractory mix which solidifies to form a monolithic layer. Combinations of these two types of linings are also possible.

In terms of the return on investment, taking into consideration both the cost of materials and useful life of the lining, as well as the time and human resources required to install the lining, a monolithic lining frequently turns out to be more economical than a lining which consists of refractory bricks. Since, as a rule, the amount of wear differs in different areas of the wall and bottom of the ladle, the lining is frequently divided into zones which have different thicknesses of the working lining and/or various grades of refractory materials which have different strengths or characteristics such as wear resistances.

Changes in modern methods of manufacturing steel have placed particularly stringent requirements on the refractory lining of casting and treatment ladles. In particular, after the transition to continuous casting, the higher tapping temperatures and the longer hold times of the molten steel in the ladle result in increased wear to the refractory lining.

After the ladle has been filled with molten steel and emptied numerous times, the working lining is either completely removed and replaced when it has reached the end of its useful life or, in the event of premature wear, it is repaired only in the damaged zones. The bottom frequently exhibits signs of wear sooner than the wall, in particular in the impact area of the casting stream and in the vicinity of the gas purging sets or ladle gates. In that case, the bottom lining must typically be removed and replaced several times during the life of the ladle. If, in the upper portion of the ladle, approximately 1 meter from the upper edge, the working lining is exposed to chemically corrosive slags, the lining in this slag zone must typically bq removed and replaced, or at least repaired, several times during the life of the ladle.

In accordance with a known lining method, the working lining of a steel casting ladle is constructed using refractory castables. This method requires a template which matches the internal contour of the finished, cast working lining. The castable refractory mix is poured into the space between the permanent lining and the template. To save installation time and increase the availability of the ladles, the bottom and the wall lining can be poured in a single process. In this manner, the bottom and the wall form a single, monolithic lining.

If only the wall lining is to be repaired, this method requires a template which matches the internal contour of the finished, cast working lining. The castable refractory mix is poured into the space between the permanent lining and the template.

Mixers, pumps and internal vibrators are generally used to perform the casting process. The casting should be performed continuously, over a period of about three hours for example, to prevent any hardening in the surface area. The vibrators are used to prevent the formation of cavities and voids and to achieve good densification. When the mix has set, e.g. after approximately 24 hours, the template can be removed.

When the wall and bottom are lined with a monolithic lining, and if premature wear occurs on the bottom, it has been found to be disadvantageous that, when the damaged portion of the bottom lining is removed, damage generally occurs to the rest of the bottom lining. Generally, the lower portion of the otherwise intact wall lining is damaged during the removal of the bottom lining, because the lining of the wall and of the bottom is a monolith. Consequently, that can mean that it is necessary to remove a major part of the wall lining prematurely.

To avoid problems in removing the bottom, the lining installation process can be performed so that a template is used which extends to the permanent lining of the bottom, and as a first step, only the wall lining is poured. After the castable refractory mix has set and the template has been removed, the bottom is poured in a second step. The result, when the bottom is later removed, is a design breaking point which prevents damage to the wall area of the lining. One disadvantage, however, is that additional time is required to allow the lining on the bottom to set before the ladle can be returned to operation, which means that the time it takes to line the vessel is almost doubled.

When a monolithic lining of the entire vessel wall is installed, one disadvantage is that if premature wear occurs in the area exposed to the slag, interim repairs to this area are so difficult that this area must continue to be lined with refractory bricks, as described in Stahl u. Eisen Special, October 1992, pp. 117–120, which is incorporated by reference herein.

OBJECT OF THE INVENTION

The object of the invention, on a steel casting and treatment ladle which has a monolithic refractory lining, is to install the bottom lining so that it becomes possible to remove the bottom lining between the walls without damage to the wall areas, in a manner which is economically advantageous. Another object, generally, of the invention is a method which makes it economically possible to restore the upper portion of the wall lining using castable refractory mix.

SUMMARY OF THE INVENTION

The present invention teaches the first of that these objects can be accomplished if, at the beginning of the installation of the castable refractory mix in the wall area, a hose-shaped, inflatable sealing body which is fastened to the lower portion of the template is inflated so that it seals the template up to the height which corresponds to the desired thickness of the bottom. As soon as the castable refractory mix in the lower portion of the wall has set sufficiently, the sealing body is deflated and removed. Then, the castable refractory mix is introduced up to the desired level in the floor area.

In one advantageous embodiment of a device which can be used for the performance of the process, the template stands on three refractory bodies 1 which are distributed over the periphery, and which have the same height as the desired thickness of the bottom lining. In the spaces between these refractory bodies, hose-shaped sealing bodies 2 are attached to the lower edge of the template. These hoses can be inflated and, when the process has been completed, they can be deflated and removed.

Following the inflation of the sealing bodies, first the wall lining is poured, during which process the sealing bodies prevent the mix from running onto the bottom. When the wall lining has been completely poured, up to the edge of the ladle, the bottom portion of the lining which is in contact with the sealing bodies begins to solidify slightly, starting from the surface, to a point where the sealing bodies can be deflated and removed. Then, before the template is removed, the bottom can be poured up to the specified height. The bottom lining in this manner no longer forms a monolith with the wall lining, but there is a design breaking point. Since there are no joints, strictly speaking, there is also no infiltration of molten steel during the use of the ladle. Following the setting time, which can generally last up to about ten hours, the template can be extracted from the ladle, and the ladle lining can be heated to the operating temperature.

The present invention also teaches that the second of these objects can be accomplished by sealing the gap between the lower end of the template and the working lining which extends below the area to be restored by inflating a hose-shaped sealing body, and by deflating the sealing body before the template is removed.

One advantage of the method proposed by the invention is that the working lining need not be entirely removed in the upper area. Nor is any special equipment required to prepare the surface. Essentially all that is necessary is to use the refractory removal machine, which is already in place and must be used anyway, with a flat chisel to remove any steel remnants and other caked material or slag. The setup times and material requirements are less than when the entire lining has to be removed and replaced with bricks. The permanent lining underneath is not damaged.

In one advantageous embodiment of a device which can be used for the performance of the process of the present invention, there is a ring, which is offset toward the inside, attached to the lower end of the template, and there is a hose-shaped inflatable sealing body. The ring is attached to the periphery of the hose-shaped inflatable sealing body. Also, there is an elastic, laceration resistant or tear resistant protective shell which is fastened to the lower edge of the template, with the shell surrounding the sealing body on the outside. In addition, the elastic protective shell presses the deflated sealing body against the ring.

To repair the upper zone of the wall, high-alumina castable refractory compounds for refractory mortar can be used.

In summary, one aspect of the invention resides broadly in method of making a refractory lining of a wall and a bottom of a metallurgical vessel, the wall being disposed substantially transverse to the floor, the method comprising the steps of: positioning a template adjacent but a predetermined distance from the wall of the metallurgical vessel to form an annular region between the template and the wall of the metallurgical vessel, disposing means for blocking against the bottom of the metallurgical vessel, blocking the annular region from the bottom of the metallurgical vessel with the blocking means to minimize leakage of castable refractory mix from the annular region, pouring castable refractory mix into the annular region, permitting the castable refractory mix in the annular region to set, pouring castable refractory mix onto the floor of the metallurgical vessel, and permitting the castable refractory mix on the floor of the metallurgical vessel to set.

Another aspect of the invention resides broadly in a device for making a refractory lining of a wall and bottom of a metallurgical vessel with castable refractory mix, the wall being disposed substantially transverse to the floor, comprising: a cylindrical template, and means for sealing the wall area from the floor area of the metallurgical vessel.

The above discussed embodiments of the present invention will be described further hereinbelow with reference to the accompanying figures. When the word "invention" is used in this specification, the word "invention" includes "inventions", that is, the plural of "invention". By stating "invention", the Applicants do not in any way admit that the present application does not include more than one patentably and non-obviously distinct invention, and maintains that this application may include more than one patentably and non-obviously distinct invention. The Applicants hereby assert that the disclosure of this application may include more than one invention, and, in the event that there is more than one invention, that these inventions may be patentable and non-obvious one with respect to the other.

BRIEF DESCRIPTION OF THE DRAWINGS

The invention is explained in greater detail below with reference to the accompanying figures.

DESCRIPTION OF THE PREFERRED EMBODIMENT

Figure 1:
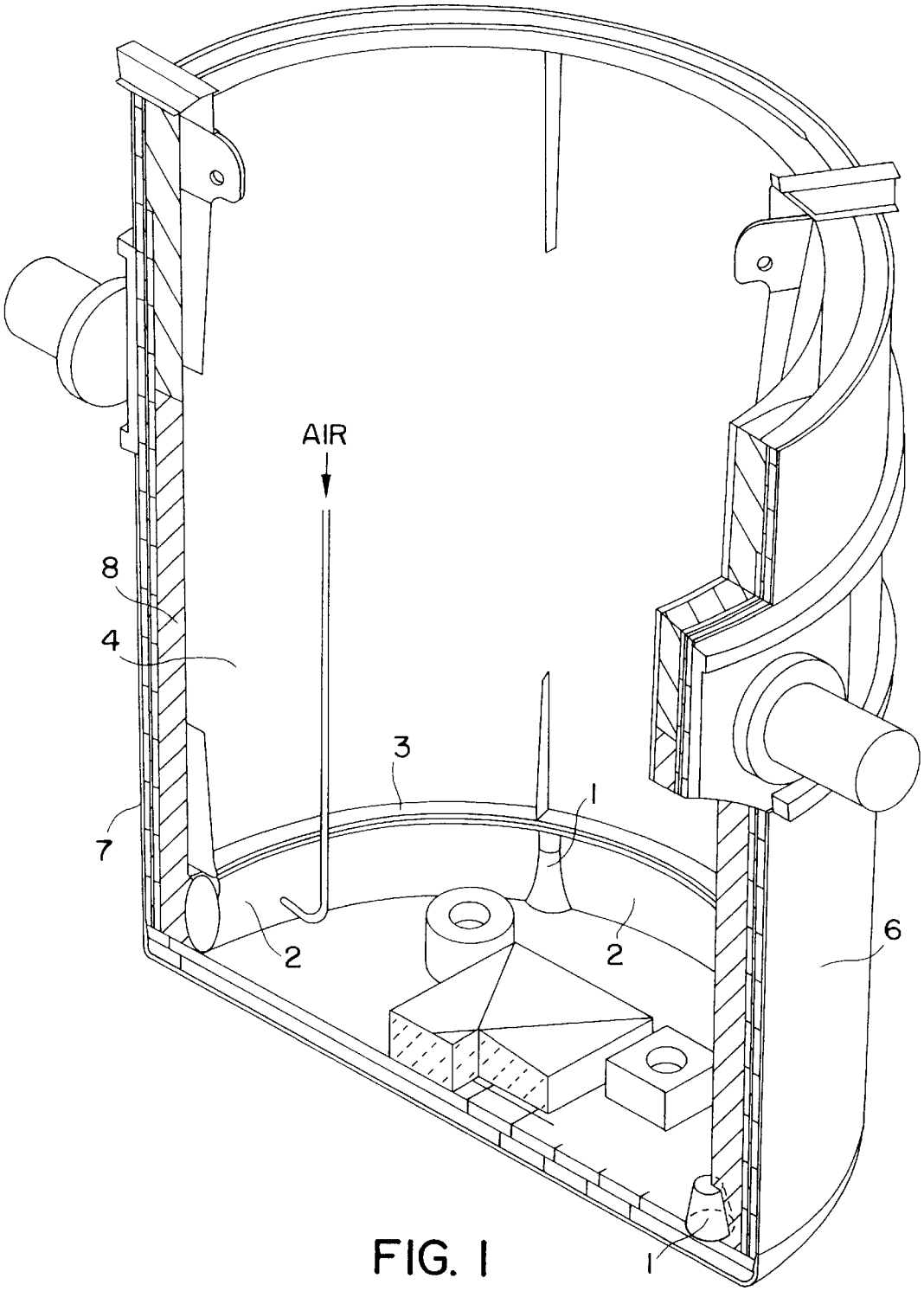
FIG. 1 is a perspective view of a metallurgical vessel.

FIG. 1 is a view in perspective of a steel casting and treatment ladle with from outside to inside the steel shell 6, the permanent lining constructed of bricks 7, the working lining 8 made of refractory mix in the wall, and the template 4. The bottom of the ladle has not yet been lined with monolithic compound. The FIGURE shows a gas purging or gate brick and a taphole pocket block or brick as well as a pre-fabricated component cast from a material which contains a high concentration of alumina and which acts as an impact plate on the permanent lining.

The template stands on refractory support bodies 1 which have the same height as the pocket blocks. On the lower edge of the template 4, on the inside, there is a strip 3 to which hose-shaped, inflatable sealing bodies 2 made of flexible material are fastened. The sealing bodies 2 can be made of plastic-reinforced rubber, for example.

Figure 2:
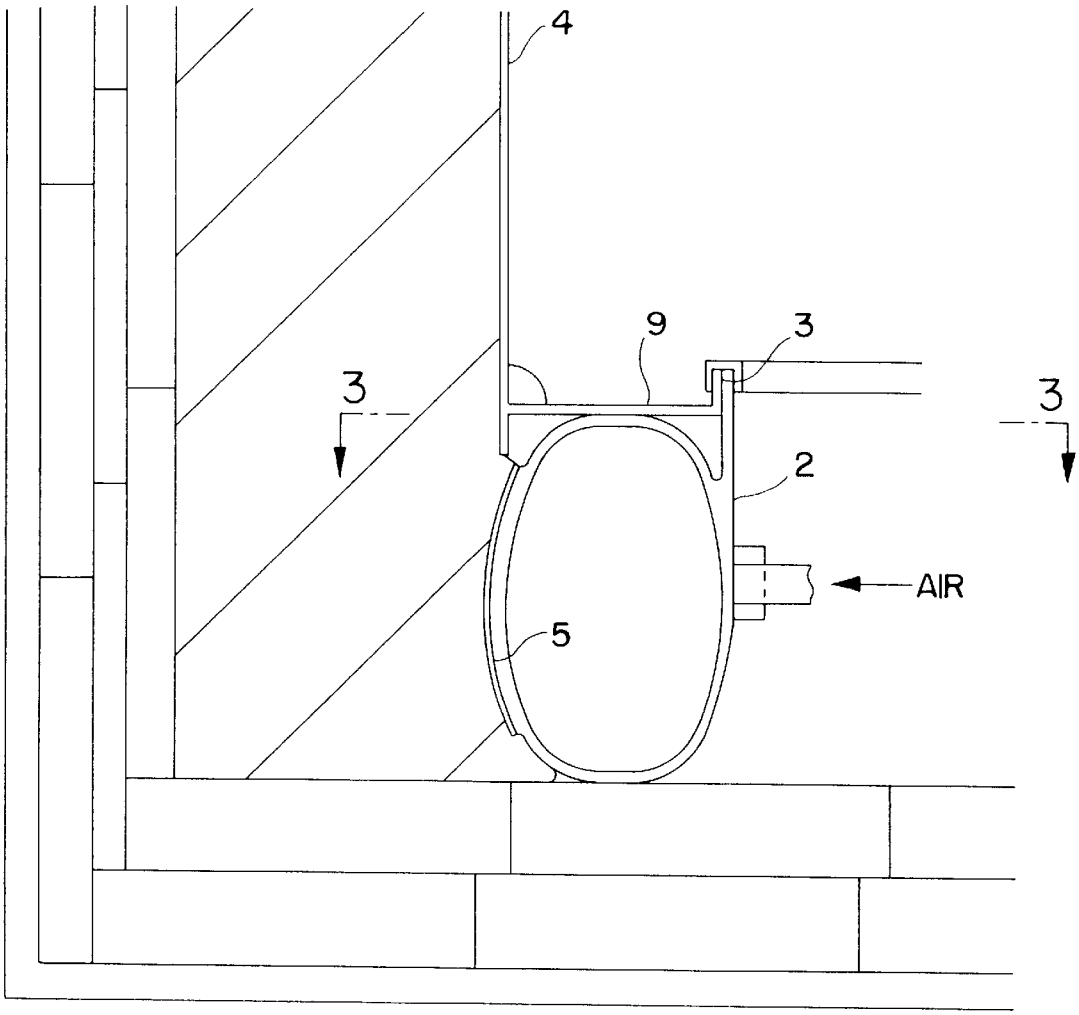
FIG. 2 shows a longitudinal cross section of the bottom of a metallurgical vessel.

FIG. 2 is a longitudinal section through the ladle showing the vicinity of the bottom end of the template 4. Somewhat above the lower edge of the template 4, a ring 9 is attached which ring 9 can be substantially transverse to the template 4 and supports a strip 3 on the inside. Fastened to the strip 3 is a hose-shaped sealing body 2 which is made of flexible material. To protect against damage, the sealing body 2 is provided on the side facing the refractory material with a protective strip 5 of laceration resistant or tear resistant, flexible material.

Figure 2A:
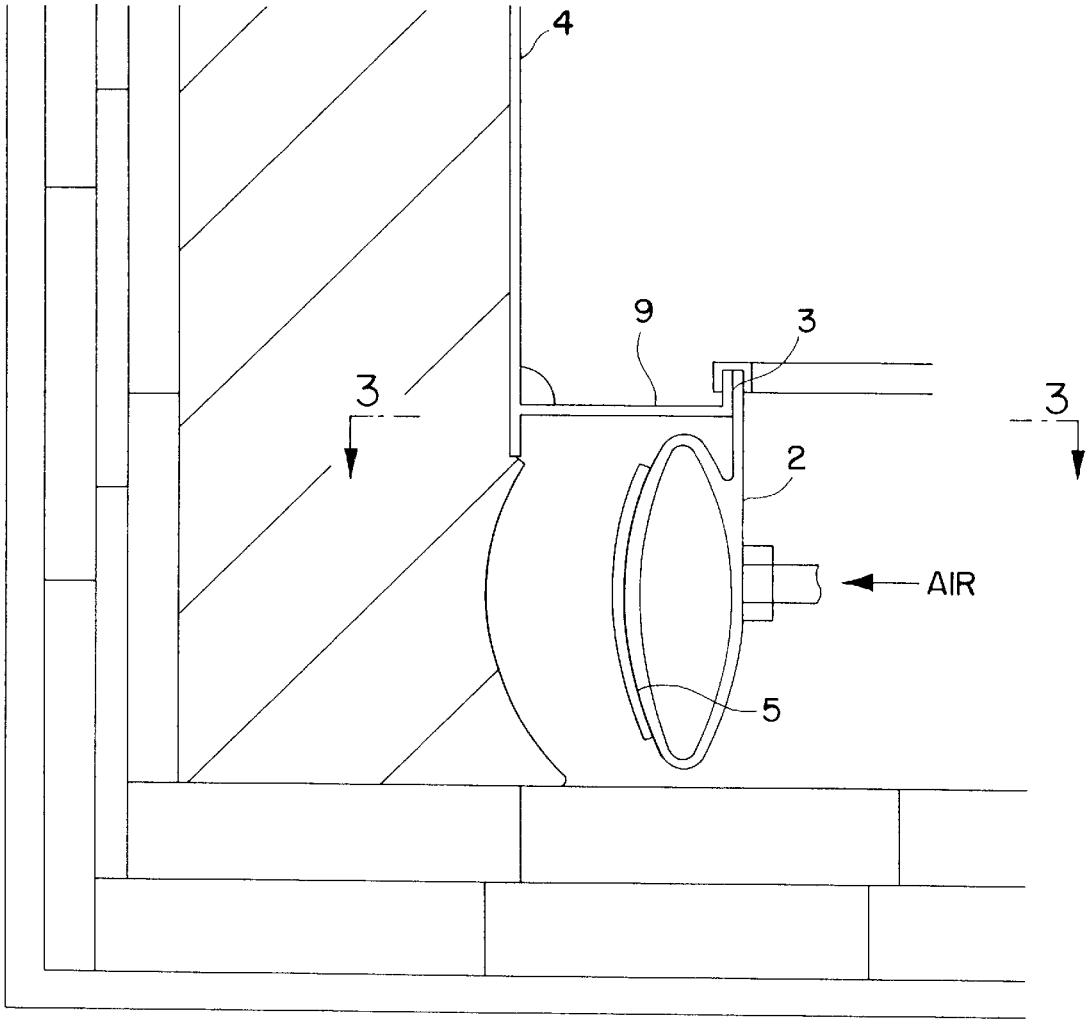
FIG. 2A shows the view of FIG. 2 with the bladder deflated.
Figure 2B:
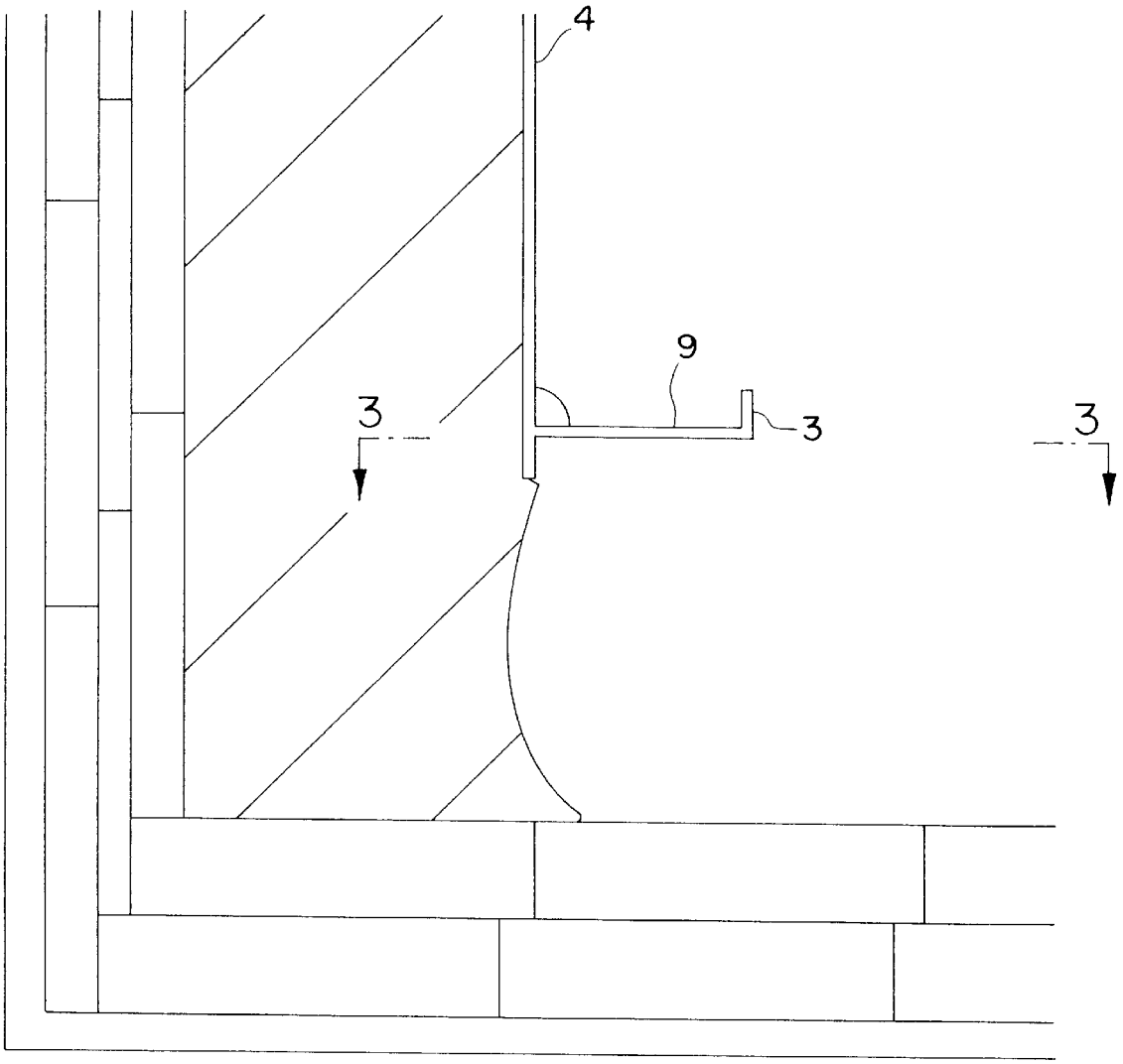
FIG. 2B shows the view of FIG. 2 with the bladder and template removed.
Figure 2C:
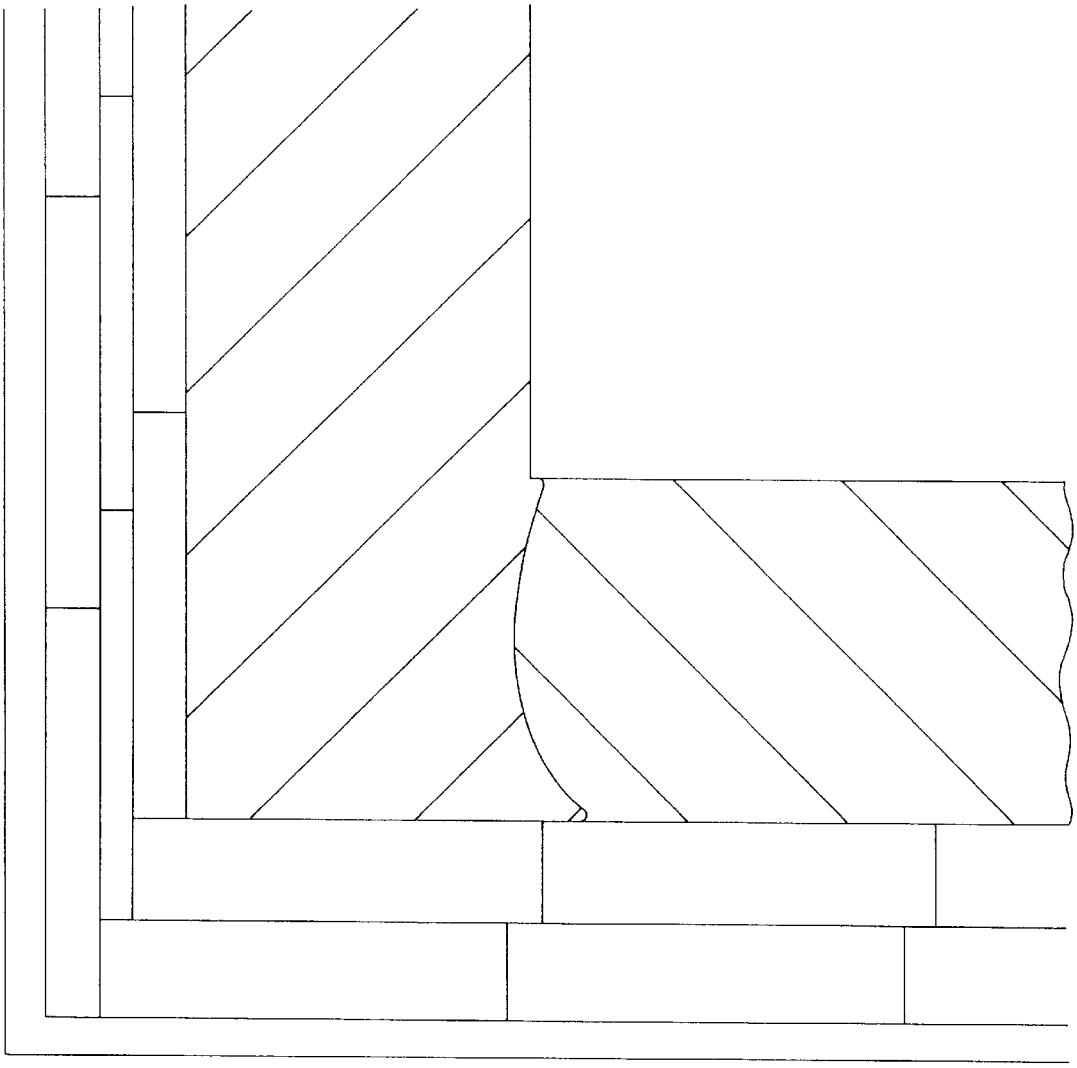
FIG. 2C shows the view of FIG. 2 with the wall portion and the bottom portion of the working lining poured.

FIG. 2A illustrates the template 4 with the hose-shaped sealing body 2 deflated. FIG. 2B illustrates the view of the metallurgical vessel shown in FIG. 2 with the template 4 and the hose-shaped inflatable sealing body 2 removed. FIG. 2C illustrates the view of FIG. 2 with the wall portion and the bottom portion of the working lining each poured.

Figure 3:
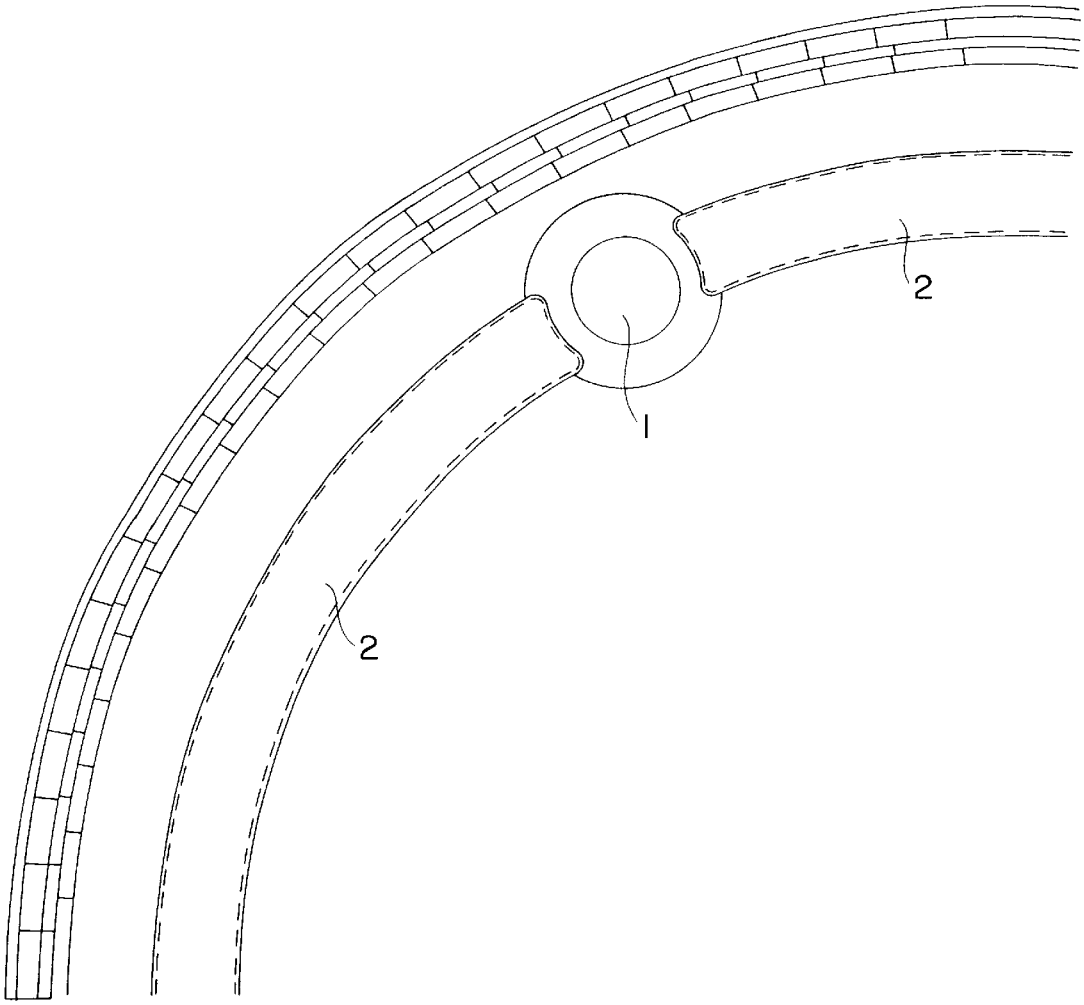
FIG. 3 is a plan view of the bottom of a metallurgical vessel.

FIG. 3 is a plan view of the bottom of the ladle, and shows a section of the refractory support body 1 which can, for example, be realized in the shape of a truncated cone, and two sealing bodies 2 which are cut so that, when inflated, they are in sufficiently tight contact without any additional means against the support body 1.

Figure 4:
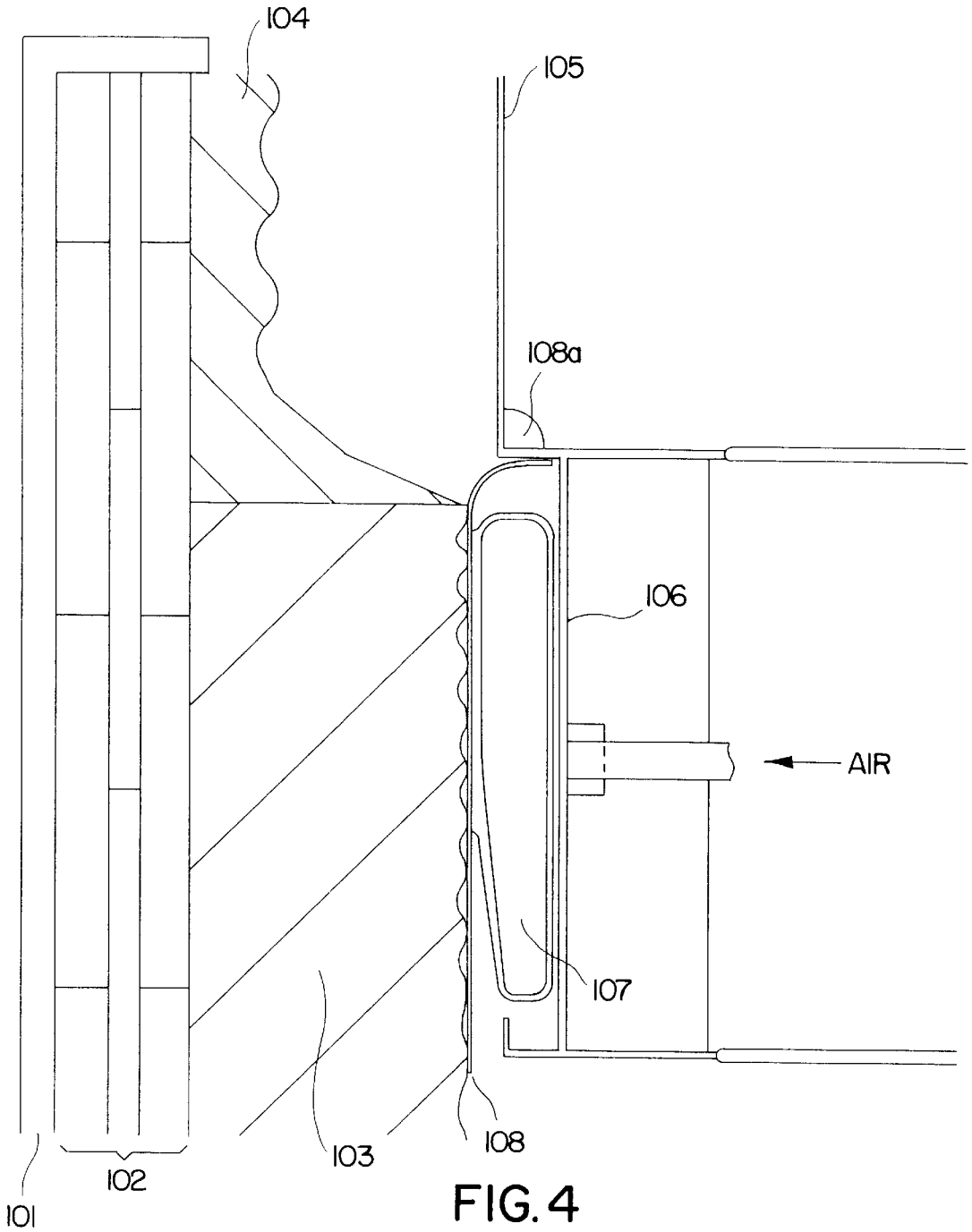
FIG. 4 is a schematic illustration of the wall area of a metallurgical vessel.

FIG. 4 is a schematic illustration of the steel shell 101, the permanent lining 102 and the working lining 103 and 104. The working lining, in the lower area 103, still has sufficient thickness remaining. The working lining in the upper area 104, however, has been worn away to the point where the ladle can no longer be used. The working lining 104 in the upper area has already been cleaned of remaining bits of steel, slag and other materials caked thereto. The template 105 is suspended in the ladle from above. Attached to the base of the template 105 is a ring 106 which is offset toward the inside. Fastened to the ring 106 is a hose-shaped sealing body 107 made of flexible material. The sealing body 107 is inflatable. In accordance with one embodiment, the sealing body 107 can be made of plastic-reinforced rubber. To protect against damage, there is a protective shell 108 between the working lining 103 and the sealing body 107. This protective shell 108 is fastened by means of its upper edge, e.g. by means of a tab, to the lower edge of the template 105. The protective shell 108 is made of laceration resistant or tear resistant flexible material, and is cut so that it exerts a bias on the sealing body 107. In accordance with one embodiment of the present invention, the tab can be considered to be the tab 108*a*.

Following the insertion of the template 105, the sealing body 107 is inflated so that it comes into sealed contact against the working lining in the lower area 103, where the lining makes the transition to the upper area 104 of the working lining.

The template 105 is then ready for the repair of the working lining in the upper area 104 by pouring castable refractory mix into the space between the remaining lining and the wall of the template 105.

Figure 5:
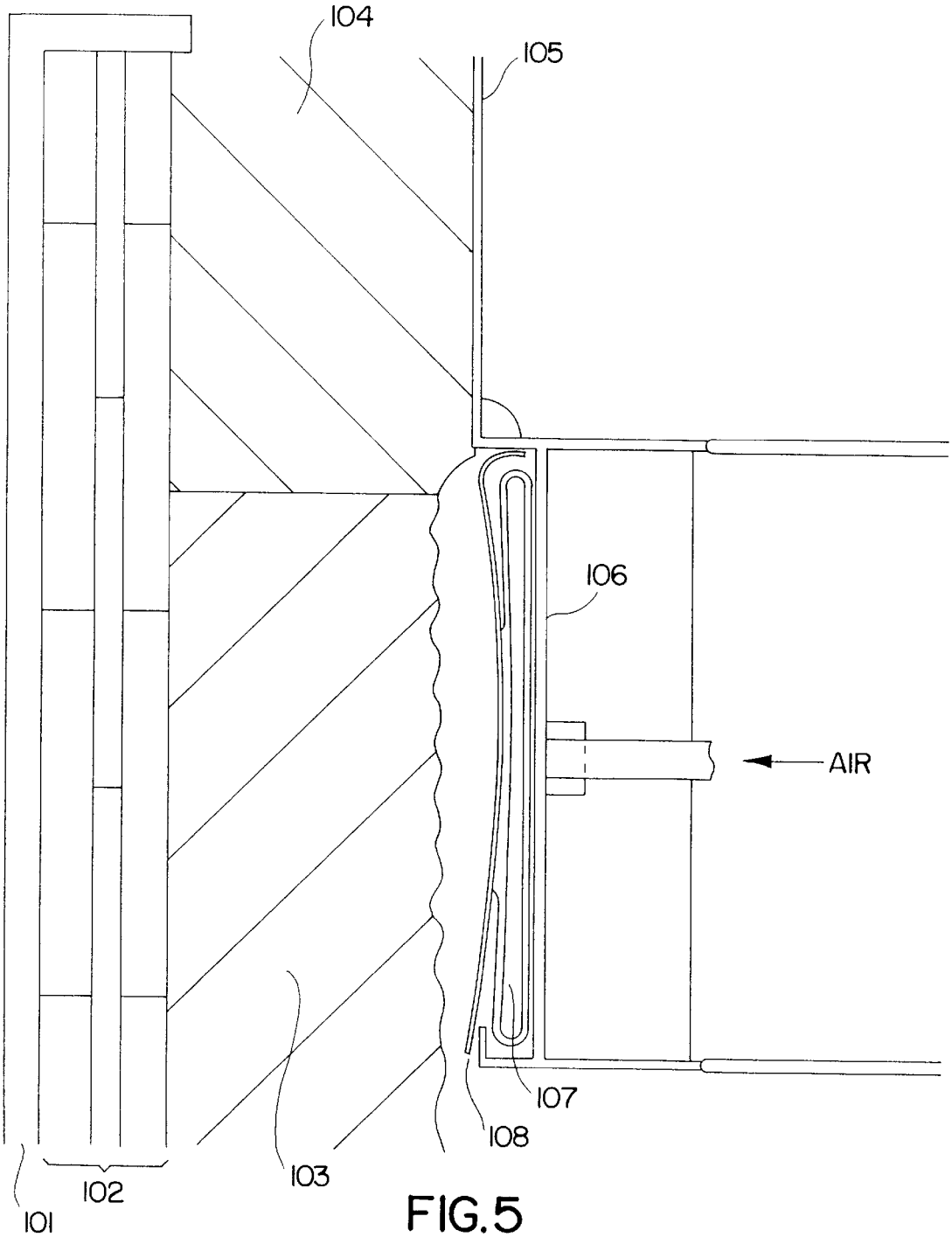
FIG. 5 is also a schematic illustration of the wall area of a metallurgical vessel.

FIG. 5 shows the situation after the completion of the repair process. The hose-shaped sealing body 107 is no longer pressurized. The protective shell 108 is no longer in contact against the working lining in the lower area 103, but as a result of its internal bias presses the hose-shaped sealing body 107 against the ring 106 on the base of the template 105. The template 105 can now be extracted upward, without damage to the sealing body 107 or to the newly-poured working lining in the upper area 104.

One feature of the invention resides broadly in the process for the manufacture of a refractory lining of the wall and bottom of a steel casting and treatment ladle, by pouring a castable refractory mix into the ring-shaped space between a template and the permanent lining, characterized by the fact that at the beginning of the introduction of the castable mix into the wall area, a hose-shaped, inflatable sealing body fastened to the bottom portion of the template is inflated so that it seals the template up to the level which corresponds to the desired thickness of the bottom, and that as soon as the castable refractory mix has set sufficiently in the lower wall area, the sealing body is deflated and removed, and then the castable refractory mix is introduced up to the desired height in the bottom area.

Another feature of the invention resides broadly in the device for the performance of the process characterized by the fact that a hose-shaped, inflatable sealing body is attached on the lower, inwardly-retracted edge of the template.

Yet another feature of the invention resides broadly in the device characterized by the fact that the template stands on at least three refractory bodies which are distributed over the periphery, and which have the same height as the desired thickness for the bottom lining, and that in the spaces between these refractory bodies, hose-shaped sealing bodies are attached on the lower edge of the template, which sealing bodies can be inflated, deflated and then removed.

Another feature of the invention resides broadly in the process for the restoration of a refractory lining in the upper portion of the wall area of a steel casting and treatment ladle, by pouring a castable refractory mix into the ring-shaped space between a template and the remaining working lining, characterized by the fact that the space between the lower end of the template and the working lining which extends below the area to be restored is sealed off by inflating a hose-shaped sealing body 107, and the sealing body 107 is deflated again before the removal of the template.

Another feature of the invention resides broadly in the device for the performance of the process characterized by the fact that attached to the lower end of the template is a ring 106 which is offset toward the inside, and the hose-shaped, inflatable sealing body. The ring is attached to the periphery of the hose-shaped, inflatable sealing body 107.

Yet another feature of the invention resides broadly in the device characterized by the fact that fastened to the lower edge of the template is an elastic protective shell 108 which surrounds the sealing body on the outside.

Still another feature of the invention resides broadly in the device characterized by the fact that the elastic protective shell 108 presses the deflated sealing body 107 against the ring 106 which is offset toward the inside.

Some examples of refractory mixtures which may be utilized in accordance with the embodiments of the present invention, may be found in the following U.S. Pat. No. 5,302,563, which issued to Rumpeltin & Dody; U.S. Pat. No. 5,284,808, which issued to Damiano, et al.; U.S. Pat. No. 5,217,929, which issued to Taft; U.S. Pat. No. 5,212,126, which issued to Fitch & Kleeb; and U.S. Pat. No. 5,204,298, which issued to Yaoi, et al.

Some examples of ladles, and components associated therewith, which may be utilized in accordance with the embodiments of the present invention, may be found in the following U.S. Pat. No. 5,465,943, which issued to Rinnhofer, et al.; U.S. Pat. No. 5,318,277, which issued to Brown, et al.; U.S. Pat. No. 5, 011,120, which issued to Bear; and U.S. Pat. No. 4,928,862, which issued to White.

Other examples of ladles, and components associated therewith, which may be utilized in accordance with the embodiments of the present invention, may be found in the following U.S. Pat. No. 5,409,139, which issued to Daussan, et al.; U.S. Pat. No. 5,395,096, which issued to Moreira, et al.; and U.S. Pat. No. 5,176,873 which issued to Daussan, et al.

Examples of inflatable sealing bodies, which may be utilized in accordance with embodiments of the present invention may be found in the following U.S. Pat. No. 5,279,092, which issued to Williamsen and Weddendorf; and U.S. Pat. No. 5,399,301 which issued to Menendez, et al.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein are hereby incorporated by reference as if set forth in their entirety herein.

The corresponding foreign and international patent publication applications, namely, Federal Republic of Germany Patent Application No. 44 03 270.6, filed on Feb. 3, 1994, having inventors Heinz Stripp, Horst Tiemann, and Roland Kessler, and DE-OS 44 03 270.6 and DE-PS 44 03 270.6 and International Application No. PCT/EP95/00399, filed on Feb. 3, 1995, are hereby incorporated by reference as if set forth in their entirety herein.

The corresponding foreign and international patent publication applications, namely, Federal Republic of Germany Patent Application No. P 44 03 271.4, filed on Feb. 3, 1994, having inventors Heinz Stripp, Wolfgang Rasim, and Horst Tiemann, and DE-OS P 44 03 271.4 and DE-PS P 44 03 271.4 and International Application No. PCT/EP95/00398, filed on Feb. 3, 1995, are hereby incorporated by reference as if set forth in their entirety herein.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clause are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

What is claimed is:

1. A method of making a refractory lining having a wall portion and a bottom portion for a metallurgical vessel, the metallurgical vessel having a wall and a bottom, the wall being disposed substantially transverse to the bottom, wherein initiation of pouring of the wall portion is begun first and initiation of pouring of the bottom portion is begun subsequent to the initiation of the pouring of the wall portion, the method comprising the steps of:

positioning a template adjacent but a predetermined distance from the wall of the metallurgical vessel to form an annular region between the template and the wall of the metallurgical vessel, wherein the annular region comprises an upper portion and a lower portion;

disposing a device to block castable refractory mix adjacent the bottom of the metallurgical vessel;

blocking the annular region from the bottom of the metallurgical vessel to a bottom of the template with the blocking device to minimize leakage of castable refractory mix from the annular region to the bottom of the metallurgical vessel;

pouring castable refractory mix into the annular region to form the wall portion of the refractory lining;

permitting the castable refractory mix in the lower portion of the annular region adjacent the blocking device to set sufficiently to permit removal of the blocking device;

removing the blocking device while the template remains in position to permit the castable refractory mix in the upper portion of the annular region to set;

initiating pouring of castable refractory mix onto the bottom of the metallurgical vessel to form the bottom portion of the refractory lining subsequent to the removal of the blocking device while the castable refractory mix in the upper portion of the annular region is setting; and permitting the castable refractory mix on the bottom of the metallurgical vessel to set.

2. The method according to claim 1 wherein the step of blocking comprises the step of sealing the annular region from the bottom of the metallurgical vessel.

3. The method according to claim 2 wherein the step of sealing comprises inflating at least one hose-shaped inflatable sealing body fastened to the bottom of the template and sealing the template up to a level corresponding to a desired thickness of the bottom portion of the refractory lining.

4. The method according to claim 3 wherein the step of removing the blocking device while the template remains in position to permit the castable refractory mix in the upper portion of the annular region to set comprises the step of deflating the at least one hose-shaped inflatable sealing body and removing the at least one hose-shaped inflatable sealing body prior to the step of initiating pouring of castable refractory mix onto the bottom of the metallurgical vessel.

5. The method according to claim 4 comprising the step of removing the template after the castable refractory mix in the upper portion of the annular region has set.

6. The method according to claim 5 comprising the step of positioning a plurality of refractory support bodies about an outer perimeter of the bottom of the metallurgical vessel to support the template prior to the step of positioning the template.

7. The method according to claim 6 comprising the step of attaching a strip of flexible, laceration-resistant material to the at least one hose shaped inflatable sealing body prior to the step of pouring castable refractory mix into the annular region.

8. A method of making a refractory lining having a wall portion and a bottom portion for a metallurgical vessel, the metallurgical vessel having a wall and a bottom, the wall being disposed substantially transverse to the bottom, wherein initiation of pouring of the wall portion is begun first and initiation of pouring of the bottom portion is begun subsequent to the initiation of the pouring of the wall portion, the method comprising the steps of:

positioning a template adjacent but a predetermined distance from the wall of the metallurgical vessel to form an annular region between the template and the wall of the metallurgical vessel, wherein the annular region comprises an upper portion and a lower portion;

disposing a device to block castable refractory mix adjacent the bottom of the metallurgical vessel and adjacent the lower portion of the annular region, wherein the lower portion of the annular region is the portion of the annular region immediately adjacent the blocking device;

blocking the annular region from the bottom of the metallurgical vessel to a bottom of the template with the blocking device to minimize leakage of castable refractory mix from the annular region to the bottom of the metallurgical vessel;

pouring castable refractory mix into the annular region to form the wall portion of the refractory lining;

permitting the castable refractory mix in the lower portion of the annular region adjacent the blocking device to set sufficiently to permit removal of the blocking device;

removing the blocking device while the template remains in position to permit the castable refractory mix in the upper portion of the annular region to set;

initiating pouring of castable refractory mix onto the bottom of the metallurgical vessel to form the bottom portion of the refractory lining subsequent to the removal of the blocking device while the castable refractory mix in the upper portion of the annular region is setting; and permitting the castable refractory mix on the bottom of the metallurgical vessel to set.

9. The method according to claim 8 wherein the step of blocking comprises the step of sealing the annular region from the bottom of the metallurgical vessel.

10. The method according to claim 9 wherein the step of sealing comprises inflating at least one hose-shaped inflatable sealing body fastened to the bottom of the template and sealing the template up to a level corresponding to a desired thickness of the bottom portion of the refractory lining.

11. The method according to claim 10 wherein the step of removing the blocking device while the template remains in position to permit the castable refractory mix in the upper portion of the annular region to set comprises the step of deflating the at least one hose-shaped inflatable sealing body and removing the at least one hose-shaped inflatable sealing body prior to the step of initiating pouring of castable refractory mix onto the bottom of the metallurgical vessel.

12. The method according to claim 11 comprising the step of removing the template after the castable refractory mix in the upper portion of the annular region has set.

13. The method according to claim 12 comprising the step of positioning a plurality of refractory support bodies about an outer perimeter of the bottom of the metallurgical vessel to support the template prior to the step of positioning the template.

14. The method according to claim 13 comprising the step of attaching a strip of flexible, laceration-resistant material to the at least one hose shaped inflatable sealing body prior to the step of pouring castable refractory mix into the annular region.

15. A method of making a refractory lining having a wall portion and a bottom portion for a metallurgical vessel, the metallurgical vessel having a wall and a bottom, the wall being disposed substantially transverse to the bottom, wherein initiation of pouring of the wall portion is begun first and initiation of pouring of the bottom portion is begun subsequent to the initiation of the pouring of the wall portion, the method comprising the steps of:

positioning a template adjacent but a predetermined distance from the wall of the metallurgical vessel to form an annular region between the template and the wall of the metallurgical vessel, wherein the annular region comprises an upper portion and a lower portion;

disposing a device to block castable refractory mix adjacent the bottom of the metallurgical vessel and adjacent the lower portion of the annular region, wherein the lower portion of the annular region is the portion of the annular region immediately adjacent the blocking device;

blocking the annular region from the bottom of the metallurgical vessel to a bottom of the template with the blocking device to minimize leakage of castable refractory mix from the annular region to the bottom of the metallurgical vessel;

pouring castable refractory mix into the annular region to form the wall portion of the refractory lining;

permitting the castable refractory mix in the lower portion of the annular region adjacent the blocking device to set sufficiently to permit removal of the blocking device;

reconfiguring the blocking device by deflating the blocking device while the template remains in position to permit the castable refractory mix in the upper portion of the annular region to set;

initiating pouring of castable refractory mix onto the bottom of the metallurgical vessel to form the bottom portion of the refractory lining subsequent to removal of the blocking device while the castable refractory mix in the upper portion of the annular region is setting; and permitting the castable refractory mix on the bottom of the metallurgical vessel to set.

16. The method according to claim 15 wherein:

the step of blocking comprises the step of sealing the annular region from the bottom of the metallurgical vessel; and the step of reconfiguring the blocking device while the template remains in position comprises removing the blocking device while the template is in position.

17. The method according to claim 16 wherein the step of sealing comprises inflating at least one hose-shaped inflatable sealing body fastened to the bottom of the template and sealing the template up to a level corresponding to a desired thickness of the bottom portion of the refractory lining.

18. The method according to claim 17 wherein the step of removing the blocking device while the template remains in position to permit the castable refractory mix in the upper portion of the annular region to set comprises the step of deflating the at least one hose-shaped inflatable sealing body and removing the at least one hose-shaped inflatable sealing body prior to the step of initiating pouring of castable refractory mix onto the bottom of the metallurgical vessel.

19. The method according to claim 18 comprising the step of removing the template after the castable refractory mix in the upper portion of the annular region has set.

20. The method according to claim 19 comprising the steps of:

positioning a plurality of refractory support bodies about an outer perimeter of the bottom of the metallurgical vessel to support the template prior to the step of positioning the template; and attaching a strip of flexible, laceration-resistant material to the at least one hose shaped inflatable sealing body prior to the step of pouring castable refractory mix into the annular region.

* * * * *

UNITED STATES PATENT AND TRADEMARK OFFICE

CERTIFICATE OF CORRECTION

PATENT NO. : 5,993,703

DATED : November 30, 1999

INVENTOR(S) : Heinz STRIPP, Horst TIEMANN, and Roland KESSLER

It is certified that error appears in the above-identified patent and that said Letters Patent is hereby corrected as shown below:

In column 2, line 5, after 'typically', delete "bq" and insert --be--.

Signed and Sealed this

Ninth Day of January, 2001

*Attest:*

*Attesting Officer*

Q. TODD DICKINSON

*Commissioner of Patents and Trademarks*